US006541172B2

(12) United States Patent
Nagasaka et al.

(10) Patent No.: US 6,541,172 B2
(45) Date of Patent: Apr. 1, 2003

(54) ELECTROPHOTOGRAPHIC PHOTOSENSITIVE MEMBER, ELECTROPHOTOGRAPHIC APPARATUS AND PROCESS CARTRIDGE

(75) Inventors: Hideaki Nagasaka, Shizuoka; Kazushige Nakamura, Kanagawa; Noriyuki Takagi, Shizuoka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/962,151

(22) Filed: Sep. 26, 2001

(65) Prior Publication Data

US 2002/0090561 A1 Jul. 11, 2002

(30) Foreign Application Priority Data

Sep. 29, 2000 (JP) ..... 2000-299615

(51) Int. Cl.[7] ..... G03G 5/10
(52) U.S. Cl. ..... 430/59.5; 430/69; 399/174
(58) Field of Search ..... 430/69, 127, 59.4, 430/59.5, 58.05; 399/174

(56) References Cited

U.S. PATENT DOCUMENTS

| | | | | |
|---|---|---|---|---|
| 4,380,384 A | | 4/1983 | Ueno et al. | 355/3 CH |
| 4,618,672 A | | 10/1986 | Hashimoto | 534/658 |
| 4,743,523 A | | 5/1988 | Yamashita et al. | 430/59 |
| 4,788,119 A | | 11/1988 | Yamashita et al. | 435/58 |
| 4,851,960 A | | 7/1989 | Nakamura et al. | 361/225 |
| 5,338,636 A | | 8/1994 | Nukada et al. | 430/78 |
| 5,549,997 A | * | 8/1996 | Matsushima et al. | 430/58.65 |
| 5,834,145 A | * | 11/1998 | Yoshinaga et al. | 430/69 |
| 6,048,657 A | * | 4/2000 | Herbert et al. | 430/137 |

FOREIGN PATENT DOCUMENTS

| | | |
|---|---|---|
| EP | 0 732 629 | 9/1996 |
| EP | 0 810 479 | 12/1997 |
| EP | 0 953 881 | 11/1999 |
| EP | 1004939 | 5/2000 |
| EP | 1 006 414 | 6/2000 |
| JP | 56-104351 | 8/1981 |
| JP | 56-167759 | 12/1981 |
| JP | 57-178267 | 11/1982 |
| JP | 58-40566 | 3/1983 |
| JP | 58-139156 | 8/1983 |
| JP | 58-150975 | 9/1983 |
| JP | 61-228453 | 10/1986 |
| JP | 61-272754 | 12/1986 |
| JP | 63-149668 | 6/1988 |
| JP | 5-188615 | 7/1993 |
| JP | 5-249716 | 9/1993 |

* cited by examiner

*Primary Examiner*—John L Goodrow
(74) *Attorney, Agent, or Firm*—Fitzpatrick, Cella, Harper & Scinto

(57) ABSTRACT

The present invention provides an electrophotographic photosensitive member wherein a maximum height (RmaxD) of a surface roughness of a support portion is 1.2 μm RmaxD≦5.0 μm, an average roughness (Rz) of 10 points is 1.2 μm≦Rz≦3.0 m, an arithmetic average roughness (Ra) is 0.15 μm≦Ra≦0.5 μm, and an irregularity average interval (Sm) is 30 μm≦Sm≦80 μm. The photosensitive member's charge generation layer contains a phthalocyanine compound, its charge transport layer has a thickness which is at least 9 μm but not larger than 18 μm, the electrophotographic photosensitive member in every 1 $cm^2$ area has an electrostatic capacity (C) of 130 pF or more. This invention also provides a process cartridge and an electrophotographic apparatus containing the electrophotographic photosensitive member.

20 Claims, 2 Drawing Sheets

ELECTROPHOTOGRAPHIC PHOTOSENSITIVE MEMBER, ELECTROPHOTOGRAPHIC APPARATUS AND PROCESS CARTRIDGE

BACKGROUND OF THE INVENTION

1. Field of the Invention

The present invention relates to an electrophotographic photosensitive member, a process cartridge containing the electrophotographic photosensitive member, and an electrophotographic apparatus containing the process cartridge. In more detail, this invention relates to an electrophotographic photosensitive member comprising a specific charge generation layer, a charge transport layer having a specific thickness, a support portion having a specific surface roughness, and possessing a specific electrostatic capacity. This invention also relates to a process cartridge containing the electrophotographic photosensitive member, as well as an electrophotographic apparatus containing the process cartridge.

2. Description of the Related Art

As an electrophotographic photosensitive member for use in an electrophotographic apparatus, there has been commonly used an organic electrophotographic photosensitive member formed by an organic photoconductive material serving as a charge generation substance. This is because the use of an organic electrophotographic photosensitive member can ensure a low production cost, as well as a high freedom in designing an electrophotographic photosensitive member. Another advantage of using an organic electrophotographic photosensitive member is that it does not cause an industrial pollution.

In fact, using an organic photoconductive material as a charge generation substance can make it possible to freely select a wavelength range of a light sensible by an electrophotographic photosensitive member. For example, a series of azo pigments disclosed in Japanese Unexamined Patent Laid-Open No. 61-272754 as well as in Japanese Patent Laid-Open No. 56-167759 have exhibited a high sensitivity in the visible light region. Further, the substances disclosed in Japanese Patent Laid-Open No. 57-19576 as well as in Japanese Patent Laid-Open No. 61-228453 have shown a high sensibility even in the infrared region.

Among the charge generation substances disclosed in the aforementioned patent publications, those exhibiting a high sensitivity in the infrared region have been used in a laser beam printer (which will sometimes be referred to as LBP in the following description) and in a LED printer, each of which is adapted to digitally form electrostatic latent images. In fact, the needs for using such charge generation substances has become more and more frequent.

Recently, laser beam printer and LED printer have become a main trend printer in the commercial market. As a result, conventional printers having resolutions of 240, 300 dpi have become those having resolutions of 400, 600, 1200 dpi.

On the other hand, various copy machines have been improved in order to be equipped with more and more functions, and this has formed a rapid development in the direction of digitalization. In particular, digital machine involves the use of a method for forming electrostatic latent images using a laser beam, and this has become a main trend in this technical field. Similarly, recent printer also involves the use of a laser beam for forming electrostatic latent images, thereby obtaining an improvement in its resolution.

Usually, an electrophotographic photosensitive member for use in digitally forming electrostatic latent images is required to have the following properties.

(1) Capable of charging in dark position to a certain potential.

(2) Dispersing amount of charges in dark position is small.

(3) Capable of rapidly dispersing charges by virtue of a light irradiation.

In particular, with regard to the above (3), an electrophotographic photosensitive member is required to have a high sensitivity in the infrared region.

On the other hand, most phthalocyanine compounds have a high sensitivity in the infrared region and thus have been widely used as a charge generation substance contained in an electrophotographic photosensitive member. Particularly, in recent years, there has been widely used an oxytitanium phthalocyanine as a material having a high sensitivity in the infrared region. In addition, Japanese Patent Laid-Open No. 5-188615 has disclosed an electrophotographic photosensitive member formed by using a chlorogallium phthalocyanine, and Japanese Patent Laid-Open No. 5-249716 has disclosed an electrophotographic photosensitive member formed by using a hydroxygallium phthalocyanine.

In this way, each of the aforementioned conventional electrophotographic photosensitive members is formed by using a phthalocyanine compound as a charge generation substance and is found to have an extremely high sensitivity not only in the visible light region but also in the infrared region. This is because a phthalocyanine compound usually has a relatively high quantum efficiency and is capable of generating a great number of carriers. Although, at the present time it is still not quite clear as to why a phthalocyanine compound can generate a great number of carriers, a possible reason for this phenomenon is supposed to be the presence of oxygen and some other impurities.

However, in the case where a great number of carriers have been generated, if the electrons having the same amount as the holes (injected into the charge transport layer) can not quickly move towards a support portion, the electrons remaining in the charge generation layer will become excessive, forming a kind of memory easy to effect a potential change.

In principle, it is allowed to consider that the electrons remaining in the charge generation layer will usually proceed (due to a certain possible reason) to an interface between the charge generation layer and the charge transport layer, thus reducing a barrier efficiency of the holes injected in the vicinity of the interface.

In fact, when an electrophotographic photosensitive member is formed by using a phthalocyanine compound as a charge generation substance, the barrier efficiency will be reduced and this fact can be confirmed by finding a reduced bright position potential and a reduced residual potential during a continuous printing process. For example, in a development process (or a so-called reversal development process) where a dark position potential portion often used in a conventional printer serves as a non-developing portion and a bright position potential portion serves as a developing portion, positions which have received a light during a former printing process will offer a quick sensitivity. Accordingly, once an entire black image is removed during a next printing process, there will occur a so-called ghost phenomenon in which a formerly printed portion will be floated out.

The above phenomenon is particularly remarkable when an electrophotographic photosensitive member contains an intermediate layer serving as an adhesive layer for supporting the charge generation layer. In particular, under an environment of a low temperature and a low humidity, since a volume resistivity against the electrons in the charge generation layer as well as in the intermediate layer will be increased, the electrons will easily fill the charge generation layer, resulting in a problem that the aforesaid ghost phenomenon is more likely to occur.

Similarly, if a reversal developing electrophotographic process employs a laminated type of a electrophotographic photosensitive member whose charge generation layer contains a phthalocyanine compound, the aforesaid ghost phenomenon will also occur. In order to solve the above problem, a commonly used method requires that an electrophotographic photosensitive member's first rotation involving a charging voltage drop is not used to form image (i.e., forming an idle rotation), but only the processes from a second rotation onward are used to form image, since each of these later processes has a stable charging voltage. Alternatively, a charge removal process is carried out by virtue of a light exposure conducted prior to a charging process, thereby avoiding the aforementioned problem. In fact, the above-described method is found to be useful in a reversal development type printer which is a conventional printer having a relatively low printing speed (for example, 10 or fewer A4 papers per minute). This is because an electric charger used in such a conventional printer usually has an extremely sufficient charge control capability, thereby effectively preventing the occurrence of the aforesaid ghost phenomenon. Moreover, since a certain time period is needed for data to be transmitted from a computer to a printer, the aforesaid idle rotation (the first rotation) will not cause any problem. However, with regard to recent digital copy machines which are required to perform a direct quick copying, the aforesaid idle rotation (the first rotation) will become an obstacle against a present trend of realizing a high speed copy machine.

Moreover, in the case where a light exposure prior to an electric charging is performed, in order to sufficiently attenuate an electric charging voltage, an exposure amount is required to be several times to 20 times an image exposure amount. As a result, an electrophotographic photosensitive member will get deteriorated due to the light exposure, and a dark position potential as well as a bright position potential during a continuous printing process will all change greatly. Accordingly, it has long been desired to research and develop an improved electrophotographic apparatus and an improved image formation method to ensure that all the rotations including a first rotation of the laminated type electrophotographic photosensitive member can be used to form image.

On the other hand, with regard to an electrophotographic method, when image is formed by carrying out several processes including electric charging, light exposure, development, transfer, fixing and cleaning, a conventional electric charging process is almost a process in which an electric charging occurs by virtue of corona generated by applying a high voltage (DC voltage: 5 to 8 kV) to metal wires.

However, the above-described electrophotographic method has been found to have the following problem. Namely, during corona generation, corona products such as ozone and $NO_x$ will change the surface structure of an electrophotographic photosensitive member, resulting in unclear image and image deterioration. Moreover, the metal wires are likely to be contaminated and the contaminated wires can bring about harmful influence to the quality of formed images, resulting in broken image and black stripe. In particular, an organic electrophotographic photosensitive member whose photosensitive layer is formed mainly by an organic photoconductive material, has been found to be chemically unstable as compared with an inorganic electrophotographic photosensitive member such as a selenium electrophotographic photosensitive member and an amorphous silicon electrophotographic photosensitive member. Moreover, the above organic electrophotographic photosensitive member is likely to get deteriorated since it is easy to receive a chemical reaction (mainly oxidation) once it is exposed to corona products. For this reason, in the case where the aforesaid organic electrophotographic photosensitive member is repeatedly used under a condition of corona charging, the deteriorated photosensitive member will produce unclear images and its sensitivity will be decreased. As a result, image concentration will become thin so that image itself will become faint, while the photosensitive member itself has only a reduced life time.

Furthermore, during the corona charging process, an electric current flowing towards the electrophotographic photosensitive member is only 5 to 30% of an entire current, with most amount of the current flowing to a shield plate, thus making the corona charging to have only a bad charging efficiency.

In order to solve the above problems, there has been suggested an improved charging method called contact type electric charging not involving the use of a corona discharger, as disclosed in Japanese Patent Laid-Open No. 57-178267, Japanese Patent Laid-Open No. 56-104351, Japanese Patent Laid-Open No. 58-40566, Japanese Patent Laid-Open No. 58-139156, Japanese Patent Laid-Open No. 58-150975.

In detail, a contact type electric charging process requires that a charging means such as an electrically conductive resilient roller (to which a DC voltage of about 1 to 2 kV has been applied) is caused to get in contact with the surface of an electrophotographic photosensitive member, thereby electrically charging the surface of the electrophotographic photosensitive member with an amount of electric charges and thus enabling the surface to have a predetermined potential.

Particularly, in recent years, the above-described contact type charging method has been incorporated into many electrophotograph apparatus, thus serving as a most commonly used electric charging method. In fact, a contact type electric charging method is almost always carried out by applying a voltage to an electrically conductive roller.

However, although the above-described contact type electric charging method has been proved to have an excellent charging efficiency, since an electric charging means such as an electrically conductive roller is caused to get direct contact with an electrophotographic photosensitive member, it has been known that a discharge insulation is likely to be broken due to even a very small defect or an ununiform portion existing within the electrophotographic photosensitive member.

On the other hand, in the case where an electrophotographic apparatus uses a semiconductor laser having a single wavelength (such semiconductor laser represents a main trend laser at present time), if the surface of a support portion for supporting an electrophotographic photosensitive member is a smooth surface, an interference phenomenon of the laser light will occur, causing an interference fringe on an image. In order to prevent such an interference fringe, it is necessary to make rough the surface of the support portion. However, such a rough surface will similarly damage a desired insulation, as would be caused by a defect existing within the electrophotographic photosensitive member. Accordingly, the roughness of the support portion, the thickness of films formed on the electrophotographic photosensitive member, the field intensity and the electric charging method are all required to be correct and appropriate.

In use, contact type electric charging can be classified into two different methods, with one applying only DC voltage, and the other overlapping an AC voltage on the DC voltage. In fact, the later method is more widely used than the former. This is because the use of the later method can avoid the damage of the discharge insulation of the electrophotographic photosensitive member (such an insulation damage would otherwise be caused due to an ununiformity of an electric charging as well as a direct application of DC voltage. In fact, an ununiformity of the electric charging will produce a stripe-like charged trace, having a length of 2 to 200 mm and a width of 0.5 mm or less, arranged in a direction orthogonal to the moving direction of an electrically charged surface. As a result, white stripe will occur during a normal development (white stripe occurs in solid black image or half tone image), while black stripe will occur during a reversal development, thus forming image defects.

In order to solve the above-discussed problem so as to improve the uniformity of an electric charging, there has been suggested a further method in which an AC voltage is overlapped on a DC voltage so as to apply tow kinds of voltages to an electric charging means (Japanese Patent Laid-Open No. 63-149668).

A method for overlapping an AC voltage on a DC voltage requires that an AC voltage ($V_{AC}$) is overlapped on a DC voltage ($V_{DC}$) so as to apply a pulsating current voltage, thereby ensuring a uniform electric charging. At this time, in order to maintain a uniformity of an electric charging so as to prevent image defects such as white spot in the normal development and to prevent black spot as well as overburden in the reversal development, it is necessary for the overlapping voltage to have an interpeak potential difference ($V_{P-P}$) which is 2 times (or more) the DC voltage.

However, if an overlapping voltage is increased in order to prevent the aforesaid image defects, a maximum applied voltage of the pulsating current voltage will bring about a damage to the discharge insulation in even very small defect portions existing within the electrophotographic photosensitive member. In fact, such sort of insulation damage is particularly remarkable in the case where an electrophotographic photosensitive member is an organic electrophotographic photosensitive member (OPC) whose voltage withstanding capability is relatively low. At this time, the normal development will suffer from an image reverse occurring in the longitudinal direction of the contacting portions, while the reversal development will suffer from an image black girdle. Furthermore, in the case where pin holes have occurred, such pin holes will server as conductive path for electric current to leak therethrough, causing a problem that a voltage applied to an electric charging means will be decreased.

In addition, when an AC voltage is overlapped during an electric charging, since a discharge current during the electric charging is larger than the case where only DC voltage is applied, the consumption amount of the surface layer of the electrophotographic photosensitive member will become large, thus bringing about a problem that the electrophotographic photosensitive member has only a deteriorated durability. In the case where an electrophotographic photosensitive member is formed by laminating a charge transport layer on a charge generation layer, a sufficient life time of the electrophotographic photosensitive member can be ensured by increasing the thickness of the charge transport layer.

However, an increase in the thickness of the charge transport layer will cause a decrease in the repeatability of electrostatic latent image. If it is a digital apparatus, the repeatability of exposure spot at each dot will become deteriorated. As a result, it is difficult for a digital apparatus (for which research has long since been carried out in order to improve its fineness) to ensure both a good picture quality and a long life time.

SUMMARY OF THE INVENTION

Accordingly, it is an object of the present invention to provide an improved electrophotographic photosensitive member which employs a phthalocyanine such as oxytitanium phthalocyanine and hydroxygallium phthalocyanine as its charge generation substance, can maintain a high sensitivity (serving as an excellent electrophotographic property), and can provide images free from ghost phenomenon. It is another object of the present invention to provide an improved process cartridge and an improved electrophotographic apparatus, each containing the improved electrophotographic photosensitive member.

It is a further object of the present invention to provide another improved electrophotographic photosensitive member which is so formed that even when a DC contact charging method is employed for effecting an electric charging, it is still possible to prevent the occurrence of black stripe having a length of 2 to 200 mm and a width of 0.5 mm or less (in a direction orthogonal to the moving direction of a charged surface), as well as the occurrence of black spot, (both the black strip and the black spot are caused due to an ununiform electric charging), thereby making it possible to elongate the life time of the photosensitive member and provide image having a high and stable picture quality. It is a still further object of the present invention to provide an improved process cartridge and an improved electrophotographic apparatus, each containing the improved electrophotographic photosensitive member.

According to the present invention, there is provided an electrophotographic photosensitive member including a support portion, a charge generation layer formed on the support portion, a charge transport layer formed on the charge generation layer, characterized in that the charge generation layer contains a phthalocyanine compound, the charge transport layer has a thickness which is at least 9 $\mu$m but not larger than 18 $\mu$m, the electrophotographic photosensitive member in every 1 $cm^2$ area has an electrostatic capacity (C) of 130 pF or more, a maximum height (RmaxD) of a surface roughness of the support portion, an average roughness (Rz) of 10 points, an arithmetic average roughness (Ra), and an irregularity average interval (Sm) have been set to satisfy the following conditions:

$$1.2\ \mu m \leqq RmaxD \leqq 5.0\ \mu m$$

$$1.2\ \mu m \leqq Rz \leqq 3.0\ m$$

$$0.15\ \mu m \leqq Ra \leqq 0.5\ \mu m$$

$$30\ \mu m < Sm \leqq 80\ \mu m$$

Further, according to the present invention there are provided a process cartridge and an electrophotographic apparatus each containing the above-described electrophotographic photosensitive member.

Further objects, features and advantages of the present invention will become more apparent from the following description of the preferred embodiments with reference to the attached drawings.

DESCRIPTION OF THE PREFERRED EMBODIMENTS

Figure 1:
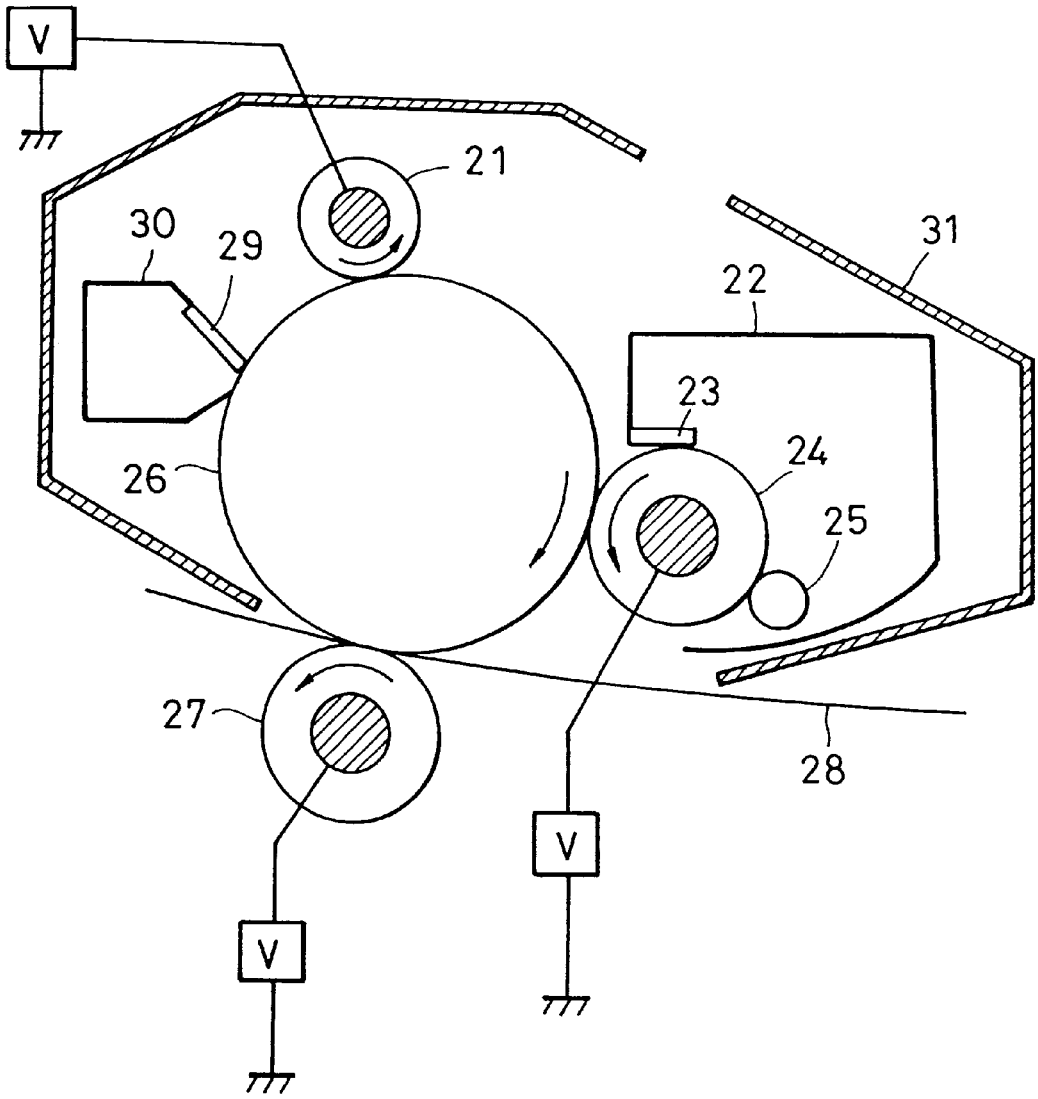
FIG. 1 is an explanatory view schematically showing the construction of an electrophotographic apparatus containing an electrophotographic photosensitive member of the present invention.

An embodiment of the present invention will be described in the following with reference to the accompanying drawings.

At first, description will be given to explain the construction of an electrophotographic photosensitive member for use in the present invention.

Namely, the electrophotographic photosensitive member of the present invention, includes a support portion, a charge generation layer formed on the support portion, a charge transport layer formed on the charge generation layer. The charge generation layer contains a phthalocyanine compound, the charge transport layer contains a charge transport substance and has a thickness which is at least 9 μm but not larger than 18 μm.

The surface roughness of the support portion of the electrophotographic photosensitive member used in the present invention will be discussed in the following.

At first, a maximum height (RmaxD) of the surface roughness of the support portion is at least 1.2 μm but not larger than 5.0 μm. Preferably, the maximum height is at least 1.2 μm but not larger than 4.5 μm. []Further, an average roughness (Rz) of 10 points is at least 1.2 μm but not larger than 3.0 μm. Preferably, the average roughness is at least 1.2 μm but not larger than 2.0 μm.

Moreover, an arithmetic average roughness (Ra) is at least 0.15 μm but not larger than 0.5 μm. Preferably, the arithmetic average roughness is at least 0.15 μm but not larger than 0.3 μm.

Furthermore, an irregularity average interval (Sm) is larger than 30 μm but not larger than 80 μm. Preferably, the irregularity average interval (Sm) is at least 31 μm but not larger than 80 μm.

Here, the above surface roughness can be measured in accordance with JIS B 0601 (1994) and the measurement can be carried out by using a surface roughness meter SURFCODER SE 3500 (Kosaka Research Institute), with cut-off being 0.8 mm and measurement length being 8 mm. In practice, an arithmetic average roughness (Ra), an average roughness (Rz) of 10 points, and an irregularity average interval (Sm) all show values set according to JIS B0601—1994, with the maximum height (RmaxD) of the surface roughness of the support portion showing Rmax DIN.

The support portion having the above-described roughness may be obtained by performing a surface roughing treatment such as horning, centerless grinding and cutting so as to treat the surface of an aluminium metal or an aluminium alloy. In fact, the present invention allows using any one of these surface roughing treatments. On the other hand, although it is possible to employ at least two of the above surface treatments, it is found that horning treatment is most favourable since this treatment can ensure a high productivity.

The horning treatment includes dry type treatment and wet type treatment, any one of which can be used to achieve the objects of the present invention. In detail, the wet type horning treatment requires that an amount of powdered horning materials are suspended in a liquid such as water so as to form a suspension liquid. Then, the suspension liquid is used to spray the surface of the support portion at a high speed, thereby forming a desired rough surface. In practice, the surface roughness can be controlled by controlling a spraying pressure, a spraying speed, the amount, type, shape, size, hardness, specific gravity of the horning material, as well as a suspension temperature. On the other hand, the dry type horning treatment requires that the powdered horning materials are blown by an air so as to spray the surface of the support portion at a high speed, thereby forming a desired rough surface. Similar to the above-mentioned wet type horning treatment, the surface roughness of the support portion can be controlled by controlling the same parameters. The horning materials suitable for use in the wet type horning treatment and the dry type horning treatment may be silicon carbide particles, alumina particles, iron particles as well as glass beads.

The centerless grinding treatment involves the use of a machine capable of grinding the surface of the support portion using a grinding stone. Such a centerless grinding machine has a grinding stone for grinding the surface of the support portion and has an adjustment gear arranged in parallel with and separated from the grinding stone so as to force the support portion to move forward. In this way, the support portion interposed between the grinding stone and the adjustment gear can obtain a forward moving force by virtue of a slight inclination of the adjustment gear, thereby allowing the support portion to move from the supply side to the discharge side and be ground by the grinding stone. Here, the grinding stone is arranged to be inclined in a manner such that its discharge side becomes narrow corresponding to a small angle with respect to the proceeding direction of the support portion.

The cutting treatment is carried out by supplying a cutting liquid and at the same time using a bite consisting of a diamond to cut the surface of the support portion. A working lathe for use in the cutting has a main shaft section for providing a rotation force to the support portion (an object being subjected to the cutting treatment) and a core pressing section for supporting the other end of the support portion, as well as a reciprocating section (cutter holder) for attaching a bite and move it. In this way, working conditions including angles of various portions of the bite, a cutting speed and a sending speed (all when the bite is used in the lathe to cut the support portion) can affect the mechanism of producing cut chips, as will as a cutting resistance, a cutting temperature, a bite life time, and the roughness of a finished cut surface.

Further, it has been understood that controlling the surface roughness of the support portion within the above ranges can prevent an interference fringe even when a single wavelength laser is used, and can also prevent an insulation damage even during a durability test.

If necessary, it is possible to provide an intermediate layer having an adhesion force and a barrier function on the support portion. Such an intermediate layer may be formed by polyamide, polyvinyl alcohol, polyethylene oxide, ethyl cellulose, casein, polyurethane and polyether urethane. Each of these materials may be at first dissolved in an appropriate solvent and then applied to the support portion. The thickness of the intermediate layer is preferred to be 0.05 to 5 μm, preferably 0.3 to 1 μm.

A charge generation layer is formed on the support portion or the intermediate layer. A phthalocyanine compound for use as a charge generation substance in the present invention may be a metal-free phthalocyanine, or a phthalocyanine pigment coordinated with a metal or its oxide chloride such as copper indium chloride, gallium chloride, oxytitanium, zinc and vanadium.

In order to ensure an excellent electrophotographic property and a high picture quality, it is preferable that a phthalocyanine compound be a metal-free phthalocyanine, an oxytitanium phthalocyanine, a hydroxygallium phthalocyanine or a halogen gallium phthalocyanine such as chlorogallium phthalocyanine. Particularly, it is preferred to use an oxytitanium phthalocyanine or a hydroxygallium phthalocyanine.

Furthermore, an oxytitanium phthalocyanine is preferred to be such that it has a peak strongly durable against the Bragg angles (2θ±0.2°) of 9.0°,14.2°, 23.9° and 27.1° in characteristic X-ray diffraction of $CuK_{\alpha}$. More preferably, a hydroxygallium phthalocyanine should be such that it has a peak strongly durable against the Bragg angles (2θ±0.2°) of 7.4°, 28.2° in characteristic X-ray diffraction of $CuK_{\alpha}$.

In practice, the above charge generation layer is allowed to contain other charge generation substances than the phthalocyanine compound, at an amount of 50 mass % with respect to the total amount of charge generation substances. For example, these other charge generation substances may be selenium-tellurium, pyrylium, thia-pyrylium dye, anthanthrone, dibenzopyrene quinone, trisazo, cyanine, disazo, monoazo, indigo, quinacridone and various other non-symmetrical quinocyanine pigments.

In this way, the charge generation layer may be formed by sufficiently dispersing the above charge generation substances in a binder resin and a solvent which together form an amount equal to 0.3 to 4 times (on the base of mass) the charge generation substances, by means of a homogenizer, an ultrasonic disperser, a ball mill, a vibration ball mill, a sand mill, an attriter, a roll mill, or a liquid collision type high speed disperser. In this way, a dispersion liquid may be obtained and applied to the support portion, followed by a drying treatment. Here, the thickness of the charge generation layer is preferred to be 5 μm or less, more preferably 0.1 to 2 μm.

Then, a charge transport layer is formed on the charge generation layer. The thickness of the charge transport layer for use in the present invention is 9 μm to 18 μm. If the thickness of the charge transport layer is less than 9 μm, it will be difficult for the electrophotographic photosensitive member to obtain a sufficient charging power. On the other hand, if the thickness of the charge transport layer is larger than 18 μm, it will be difficult to ensure a stabilized electric charging and thus the electric charging will not be uniform.

Actually, the charge transport layer may be formed by at first dissolving mainly a charge transport substance and a binder resin in a solvent so as to form a liquid coating material. Then, the liquid coating material is applied to the charge generation layer, followed by a drying treatment. Here, the charge transport substance may be a triarylamine compound, a hydrazone compound, a stilbene compound, a pyrazoline compound, an oxazole compound, a triaryl methane compound or a thiazole compound.

Such a charge transport substance is mixed with 0.5 to 2 times (on the base of mass) the binder resin so as to form a liquid coating material. The liquid coating material is then applied to the charge generation layer, followed by a drying treatment, thereby forming the desired charge transport layer.

In order to improve the mechanical strength of an electrophotographic photosensitive member, a binder resin for use in the charge transport layer is preferred to be a polyarylate resin consisting of constitutive units represented by the following formula (1), used in a single form. Alternatively, the polyarylate resin is used in the form of a mixture containing the polyarylate resin and another resin such as a polycarbonate resin, a polyester resin, a polymethacrylate ester resin, a polystyrene resin, a polyacryl resin and a polyamide resin, as well as an organic photoconductive polymer such as poly-N-vinyl carbazole and polyvinyl anthracene.

(1)

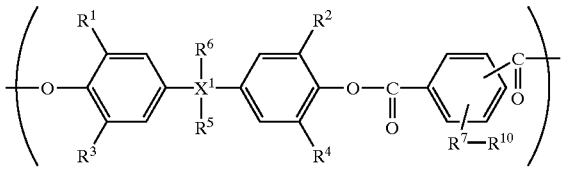

In the above formula, $X^1$ represents a carbon atom or a single bond (when $X^1$ represents a single bond, $R^5$ and $R^6$ are not present), $R^1$ to $R^4$ represent a hydrogen atom, a halogen atom, a substituted or unsubstituted alkyl group or a substituted or unsubstituted aryl group, $R^5$ and $R^6$ represent a hydrogen atom, a halogen atom, a substituted or unsubstituted alkyl group and a substituted or unsubstituted aryl group, or an alkylidene group formed by combining $R^5$ with $R^6$, and $R^7$ to $R^{10}$ also represent a hydrogen atom, a halogen atom, a substituted or unsubstituted alkyl group or a substituted or unsubstituted aryl group.

In this way, if the charge transport layer is formed by using the above polyarylate resin, it is possible for the mechanical wear of the electrophotographic photosensitive member to be reduced to an extremely small extent. Thus, in the case where the aforesaid DC contact type electric charging method is employed, even if the thickness of the charge transport layer is made to be 9 to 18 μm for the purpose of further improving an electric charging uniformity, it is still possible to ensure a relatively long life time for the electrophotographic photosensitive member. Namely, in the case where the aforesaid DC contact type electric charging method is employed, it is possible for the photosensitive member to obtain (at a further higher level) both an electric charging stability and a relatively long life time.

Although the following Table 1 is used to show in detail some useful constitutive units represented by formula (1) for synthesizing binder resins, the present invention should not be limited to these specific examples.

TABLE 1
Constitutive Unit (1)-1
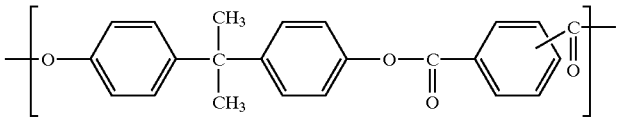
Constitutive Unit (1)-2
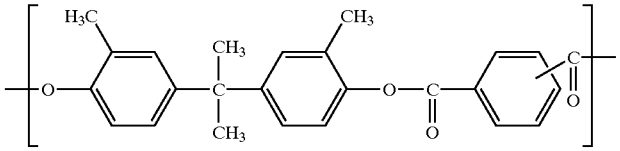
Constitutive Unit (1)-3
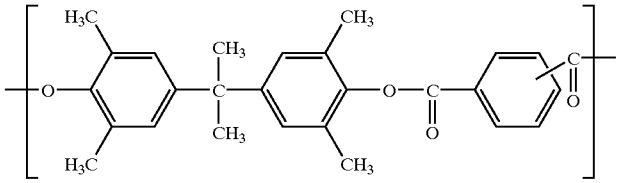
Constitutive Unit (1)-4
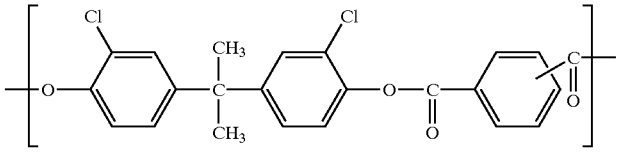
Constitutive Unit (1)-5
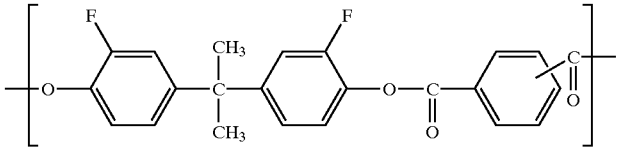
Constitutive Unit (1)-6
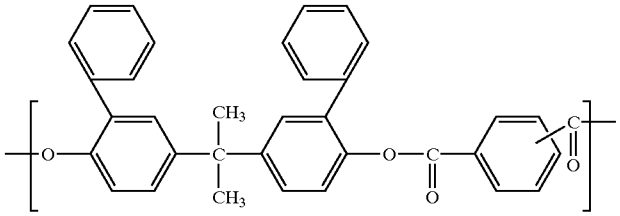
Constitutive Unit (1)-7
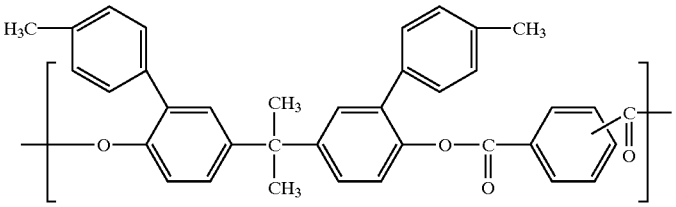
Constitutive Unit (1)-8
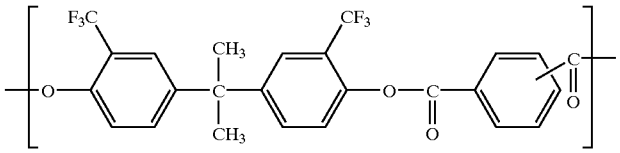
Constitutive Unit (1)-9
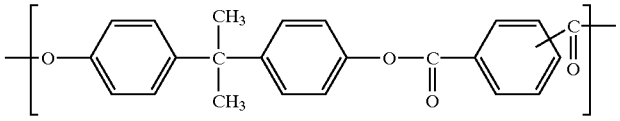

TABLE 1-continued
Constitutive Unit (1)-10
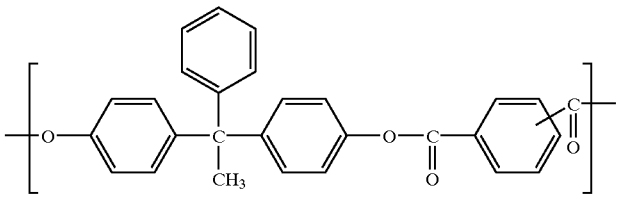
Constitutive Unit (1)-11
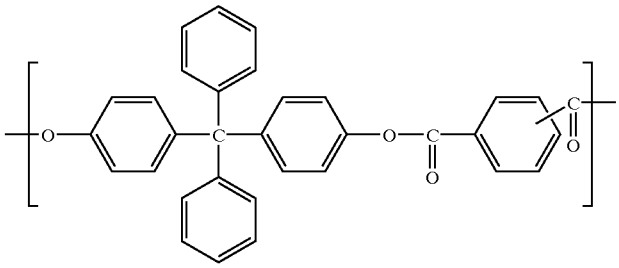
Constitutive Unit (1)-12
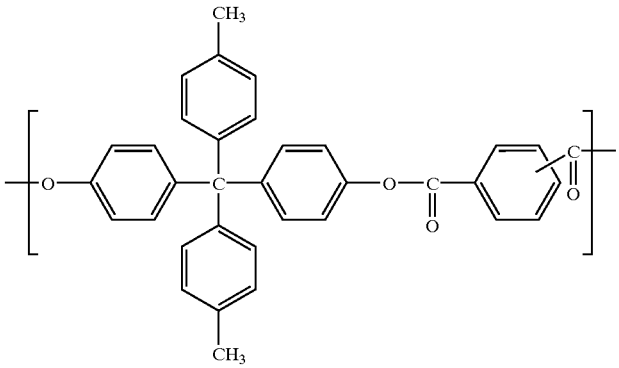
Constitutive Unit (1)-13
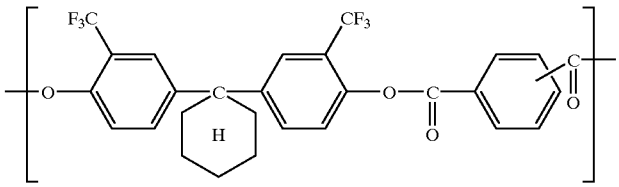
Constitutive Unit (1)-14
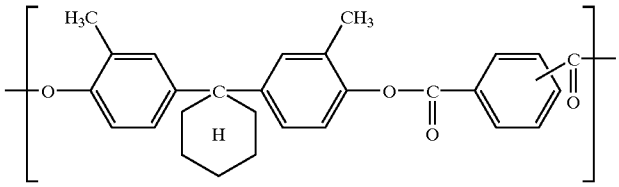
Constitutive Unit (1)-15
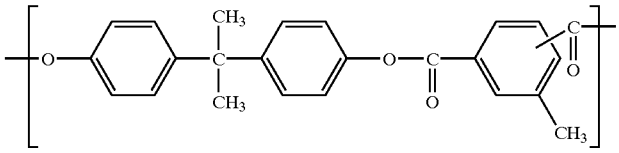
Constitutive Unit (1)-16
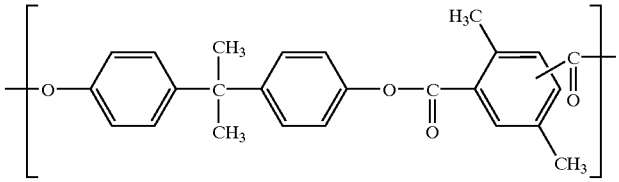

TABLE 1-continued

| | |
|---|---|
| Constitutive Unit (1)-17 | 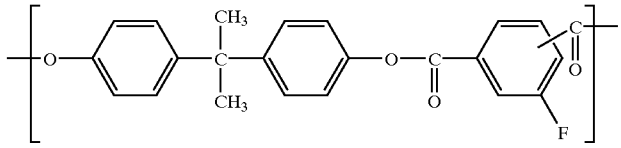 |
| Constitutive Unit (1)-18 | 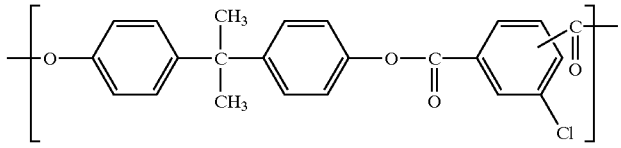 |
| Constitutive Unit (1)-19 | 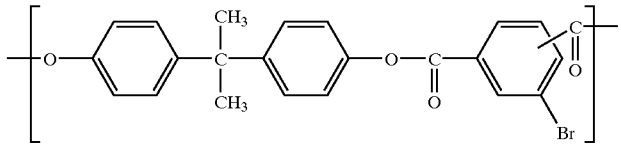 |
| Constitutive Unit (1)-20 | 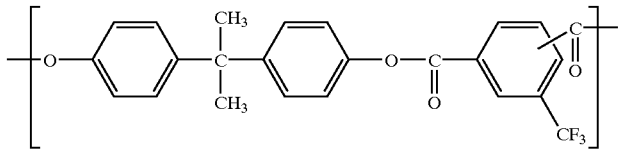 |
| Constitutive Unit (1)-21 | 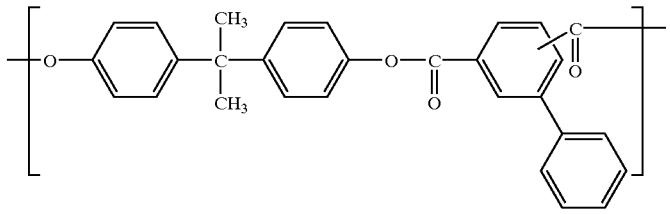 |
| Constitutive Unit (1)-22 | 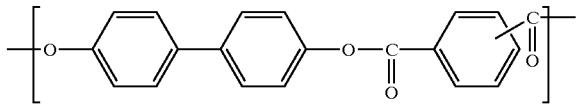 |
| Constitutive Unit (1)-23 | 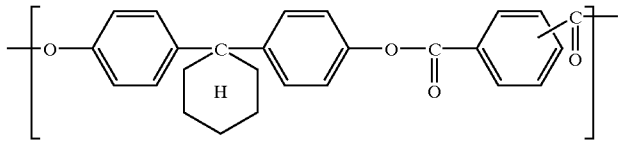 |

Among the above examples shown in Table 1, it is preferable to use constitutive units (1)-1, (1)-2, (1)-3, (1)-10, (1)-15 and (1)-23. Further, with the electrophotographic photosensitive member of the present invention, it is possible for a binder resin to be formed by a polymer obtained by synthesizing the same identical constitutive units represented by the above formula (1), but also possible for it to be formed by a copolymer obtained by synthesizing two or more different kinds of constitutive units represented by the formula (1).

Moreover, in the present invention, a viscosity average molecular weight of the polyarylate resin is preferred to be 10,000 to 200,000, more preferably 15,000 to 100,000.

As a result of repeated and diligent research on how to prevent a ghost phenomenon remarkably occurring on an electrophotographic photosensitive member formed by a phthalocyanine compound as a charge generation substance, it has been found that such ghost phenomenon can be inhibited by making the thickness of the charge transport layer to be within 9 to 18 $\mu$m and by making an electrostatic capacity (per 1 $cm^2$) of an electrophotographic photosensitive member to be 130 pF or more.

Namely, a large amount of carriers will be generated in the photosensitive layer by virtue of an exposure history and will remain within the photosensitive layer. Then, in a next cycle, potential in an exposure history section will rise and an electric charging potential will drop due to the discharge of remaining carriers, thus causing the ghost phenomenon. In view of this, if the thickness of the charge transport layer of the electrophotographic photosensitive member is made to be 9 to 18 $\mu$m and if an electrostatic capacity (C) (per 1 $cm^2$) of an electrophotographic photosensitive member is made to be 130 pF or more, holes can be easily injected into an interface between the charge transport layer and the charge generation layer, while electrons are allowed to easily move from the charge generation layer toward the support portion. In this way, it is possible to reduce the residual carriers, thereby effectively inhibiting the occurrence of the ghost phenomenon.

Furthermore, when the intensity of an electric field being applied to the electrophotographic photosensitive member is controlled within a range of $3.3\times10^5$ to $8.1\times10^5$ V/cm, an effect of inhibiting the ghost phenomenon will be more remarkable.

Besides, in the case where the DC contact type electric charging method is used to carry out the desired electric charging, the electrophotographic photosensitive member of the present invention (the thickness of its charge transport layer is 9 to 18 $\mu$m and the electrostatic capacity (C) (per 1 $cm^2$) of the electrophotographic photosensitive member is 130 pF or more) has been found to be effective in inhibiting stripes each having a length of 2 to 200 mm and a width of at most 0.5 mm (arranged in a direction orthogonal to the moving direction of the charged surface).

The contact type electric charging method in which an electric charging means is caused to get in contact with the electrophotographic photosensitive member, can effect the desired electric charging by virtue of gap destructive discharge in accordance with Paschen's Law, with such gap destructive discharge occurring in small spaces near the contact position between the electrophotographic photosensitive member and the electric charging means. Here, although the photosensitive member of an electrophotographic apparatus is usually in the form of a drum or a belt, such a drum or a belt is caused to rotate with respect to an electric charging means so as to effect the desired electric charging. Namely, the contact position between the electrophotographic photosensitive member and the electric charging means is caused to serve as a boundary surface so as to divide an electric charging area into an upstream side and a downstream side, thereby effecting the electric charging in two small spaces on either the upstream side or the downstream side. At this time, although the gap destructive discharge in accordance with Paschen's Law can be conducted, the dielectric constant, the layer thickness and the electrostatic capacity (C) of the electrophotographic photosensitive member, as well as the resistance value and the application voltage of the electric charging means will all act in accordance with an electric charging mechanism. As a result, effecting a uniform electric charging is not easy. In order to solve this problem, there has been suggested an improved electric charging method which requires that an electric charging be carried out by virtue of a pulsating voltage overlapped with an AC voltage.

However, the electrophotographic photosensitive member of the present invention is capable of effecting a uniform electric charging, obtaining the same result as obtainable in the case where an electric charging is effected by virtue of a pulsating voltage (even if the photosensitive member of the invention is used under a condition where an electric charging is effected by applying only a DC voltage).

Namely, if the thickness of the charge transport layer of the electrophotographic photosensitive member is made to be 9 to 18 $\mu$m and if an electrostatic capacity (C) (per 1 $cm^2$) of an electrophotographic photosensitive member is made to be 130 pF or more, it is possible to stably inhibit the formation of an electric field in an adverse direction (which may be considered to be a cause responsible for the formation of stripe image). Therefore, it has become possible to perform a uniform electric charging which will not produce stripe image, thereby obtaining the same advantage as obtainable in the case where an entire electric charging is carried out by virtue of a pulsating voltage.

In this way, when the DC contact type charging method is employed, it is sure to prevent the aforesaid problems which would otherwise be caused in an electric charging involving an overlapping of an AC voltage with a pulsating voltage.

However, in the present invention, from the view point of improving an electric charging power of an electric charging means, it is preferable that an electrostatic capacity (C) (per 1 $cm^2$) of an electrophotographic photosensitive member be 500 pF or less, preferably 350 pF or less.

Next, description will be given to explain an electrophotographic apparatus containing an electrophotographic photosensitive member formed according to the present invention.

FIG. 1 is an explanatory view schematically showing the electrophotographic apparatus of the present invention.

In fact, the electrophotographic apparatus shown in FIG. 1 includes an electrophotographic photosensitive member 26, an electric charging roller 21 serving as an electric charging means and arranged in contact with the photosensitive member 26, in a manner such that the electric charging roller 21 can uniformly charge the electrophotographic photosensitive member only by virtue of a DC voltage. After the electric charging, image portions are exposed to a laser light so as to effect a light exposure treatment. In this way, an electrostatic latent image can be formed and then converted into a visible image (toner image) using a developing means 22 comprising a developing roller 24 that receives developer from developer container 23, the thickness of the layer of developer or the roller 24 being regulated by roller 25. Subsequently, the toner image is transferred to a transfer material 28 by means of a transfer roller 27 (to which a voltage has been applied). At this time, the surface of the electrophotographic photosensitive member 26 (after image transfer) is cleaned by a cleaning means 30 having a cleaning blade 29 so as to remove the remaining toner therefrom, thereby allowing the photosensitive member to be used in a next cycle. However, with the electrophotographic apparatus of the present invention, it is not necessary to perform a charge removal treatment on the surface of the electrophotographic photosensitive member by using a pre-exposing light coming from a pre-exposing means.

Furthermore, if necessary, the electrophotographic photosensitive member 26, the electric charging means 21, the developing means 22 and the cleaning means 30 may be integrally supported together, thereby forming a process cartridge 31 which can be detachably installed into the electrophotographic apparatus.

In the following, description will be given to explain in further detail the present invention, by performing a comparison between examples and comparative examples. However, the present invention should not be limited to these examples. In the following examples, "part" means "parts by mass".

<Electrophotographic Photosensitive Member Manufacturing Example 1>

An A3003 aluminium pipe (ED pipe) obtained through hot extrusion and having an outer diameter of 30.5 mm, an inner diameter of 28.5 and a length of 260.5 mm was prepared. Then, a liquid (wet type) horning apparatus (manufactured by Fuji Precision Machine Manufacturing Co., Ltd.) was used to perform a liquid horning treatment under the following conditions.

Liquid Horning Condition:

Particles of grinding material=spherical alumina beads (trade name: CB-A30S manufactured by Showa Denko Co., Ltd.)

Suspension medium=water

Grinding material/suspension Medium=1/9 (volume ratio)

Rotation speed of the alminium pipe=1.67 $s^{-1}$

Air spraying pressure=0.165 MPa

Gun moving speed=13.3 mm/s

A distance between the gun nozzle and the aluminium pipe=180 mm

Horning particle discharging angle=45°

Grinding liquid emission=once

A surface roughness was measured in accordance with JIS B 0601, using a surface roughness meter SURFCODER SE3500 (made by Kozaka Research Institute), with cut-off being 0.8 mm and measurement length being 8 mm. The surface roughness of the cylinder after horning treatment was found to be RmaxD=3.0, Rz=1.6 μm, Ra=0.24 μm, Sm=34 μm.

Then, 3 parts of N-methoxymetyl polyamide resin (trade name: TREJIN EF-30T, manufactured by Empire Chemistry Co., Ltd.) and 1 part of copolymer polyamide resin (trade name: AMIRAN CM8000, manufactured by Tore Co., Ltd.) were dissolved in a mixed solution containing 40 parts of methanol and 20 parts of n-buthanol, thereby obtaining a liquid coating material. The liquid coating material was then applied using a dipping treatment, thereby obtaining an intermediate layer having a thickness of 0.65 pm.

Next, 4 parts of oxytitanium phthalocyanine (TiOPc) having a peak strongly durable against the Bragg angles (2θ±0.2°) of 9.0°, 14.2°, 23.9° and 27.1° in characteristic X-ray diffraction of $CuK_{\alpha}$, 2 parts of polyvinyl butyral (trade name: ESLECK BM2, manufactured by Sekisui Chemistry Co., Ltd.), and 60 parts of cyclohexanone were dispersed for 4 hours in a sand mill apparatus using glass beads each having a diameter of 1 mm. Then, 100 parts of ethyl acetate was added so as to prepare a dispersion liquid for forming a charge generation layer. Subsequently, the dispersion liquid was applied using a dipping treatment, thereby forming a charge generation layer having a thickness of 0.3 μm.

Afterwards, a coating material was prepared which could be later used to form a charge transport layer. Then, 10 parts of polyarylate resin consisting of constitutive units represented by (1)-2 (such a polyarylate resin is a copolymer formed by synthesizing two kinds of constitutive units, with one containing ester group in m-position and the other in p-position, each occupying 50% in the copolymer) serving as a binder resin, 9 parts of an amine compound having the following formula

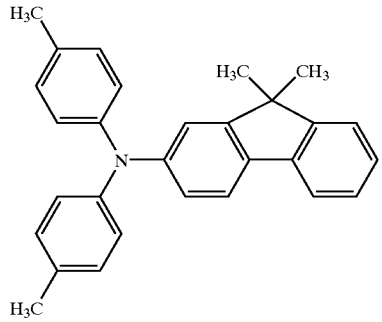

1 part of another amine compound having the following formula

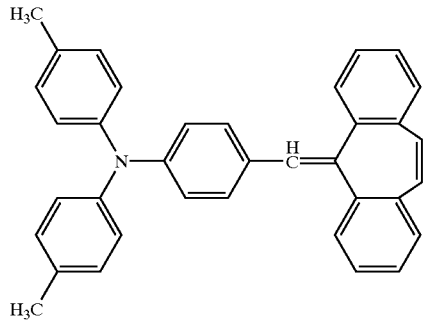

were dissolved in a mixed solvent containing 50 parts of monochlorobenzene and 50 parts of dichloromethane, thereby obtaining a coating material. Then, the coating material was applied using a dipping treatment and dried at a temperature of 120° C. for 2 hours, thereby forming a charge transport layer having a thickness of 9 μm, and thus producing an electrophotographic photosensitive member.

<Electrophotographic Photosensitive Member Manufacturing Example 2>

This manufacturing example is almost the same as the above Manufacturing Example 1 except that the charge transport layer was made to have a thickness of 14 μm, thereby producing an electrophotographic photosensitive member in the same manner as in the above Manufacturing Example 1.

<Electrophotographic Photosensitive Member Manufacturing Example 3>

This manufacturing example is almost the same as the above Manufacturing Example 1 except that the charge transport layer was made to have a thickness of 18 μm, thereby producing an electrophotographic photosensitive member in the same manner as in the above Manufacturing Example 1.

<Electrophotographic Photosensitive Member Manufacturing Example 4>

This manufacturing example is almost the same as the Manufacturing Example 3 except that a binder resin for use in the charge transport layer was a compound consisting of constitutive units represented by (1)-15 (which is a copolymer formed by synthesizing two kinds of constitutive units, with one containing ester group in m-position and the other in p-position, each occupying 50% in the copolymer), thereby producing an electrophotographic photosensitive member in the same manner as in the above Manufacturing Example 3.

<Electrophotographic Photosensitive Member Manufacturing Example 5>

This manufacturing example is almost the same as the above Manufacturing Example 1 except that the charge transport layer was made to have a thickness of 20 μm, thereby producing an electrophotographic photosensitive member in the same manner as in the above Manufacturing Example 1.

<Electrophotographic Photosensitive Member Manufacturing Example 6>

This manufacturing example is almost the same as the above Manufacturing Example 1 except that the charge transport layer was made to have a thickness of 25 μm, thereby producing an electrophotographic photosensitive member in the same manner as in the above Manufacturing Example 1.

<Electrophotographic Photosensitive Member Manufacturing Example 7>

This manufacturing example is almost the same as the above manufacturing Example 1 except that the charge transport layer was made to have a thickness of 8 μm, thereby producing an electrophotographic photosensitive member in the same manner as in the above Manufacturing Example 1.

<Electrophotographic Photosensitive Member Manufacturing Example 8>

This manufacturing example is almost the same as the above Manufacturing Example 3 except that a binder resin for use in the charge transport layer was polystyrene, thereby producing an electrophotographic photosensitive member in the same manner as in the above Manufacturing Example 3.

<Examples 1 to 4 and Comparative Examples 1 to 4>

The electrophotographic photosensitive members produced in the above Manufacturing Examples 1 to 8 were used as shown in Table 2. An LBP (Laser Jet 4000, manufactured by Hewlett Packard Co., Ltd.) (process speed: 94.2 mm/s) capable of performing a contact type electric charging but not having a charge removal function shown in FIG. 1, was reformed into a structure capable of carrying out DC electric charging. Then, process conditions were set as follows and evaluation was conducted.

Electrophotographic photosensitive member dark position potential: −600 V

Electrophotographic photosensitive member bright position potential: −150 V

Development bias: −350 V (DC voltage only)

The evaluation was carried out under a condition of 15° C./10 RH %, thereby evaluating an initial image. In detail, image evaluation was conducted in the following manner. Namely, in an area from the start of printed image to one rotation of the electrophotographic photosensitive member, solid black pieces each having a square shape of 25 mm are arranged. Then, from the photosensitive member's second rotation onward, ghost phenomenon was evaluated by using a half-tone test chart having printed thereon 1 dot using a checker. Afterwards, in accordance with another half-tone test chart having printed thereon 1 dot using a checker, and in view of the solid black images, another evaluation was carried out to evaluate black stripes, black spots and interference fringes caused due to an ununiform electric charging. Subsequently, the printing of 15000 sheets of pictures was continuously performed on A4 papers, using a printing pattern having an area ratio of 4%, followed by evaluating the formed pictures. The evaluation results and the surface roughness of the support portions obtained in the respective manufacturing examples are shown in Table 2.

In fact, the above evaluation was made mainly to observe some image defects including ghost phenomenon, black stripe, black spot and interference fringe, with the observation being divided into the following five stages.

A: not found at all

B: almost not found at all

C: little was found

D: found

E: clearly found

Figure 2:
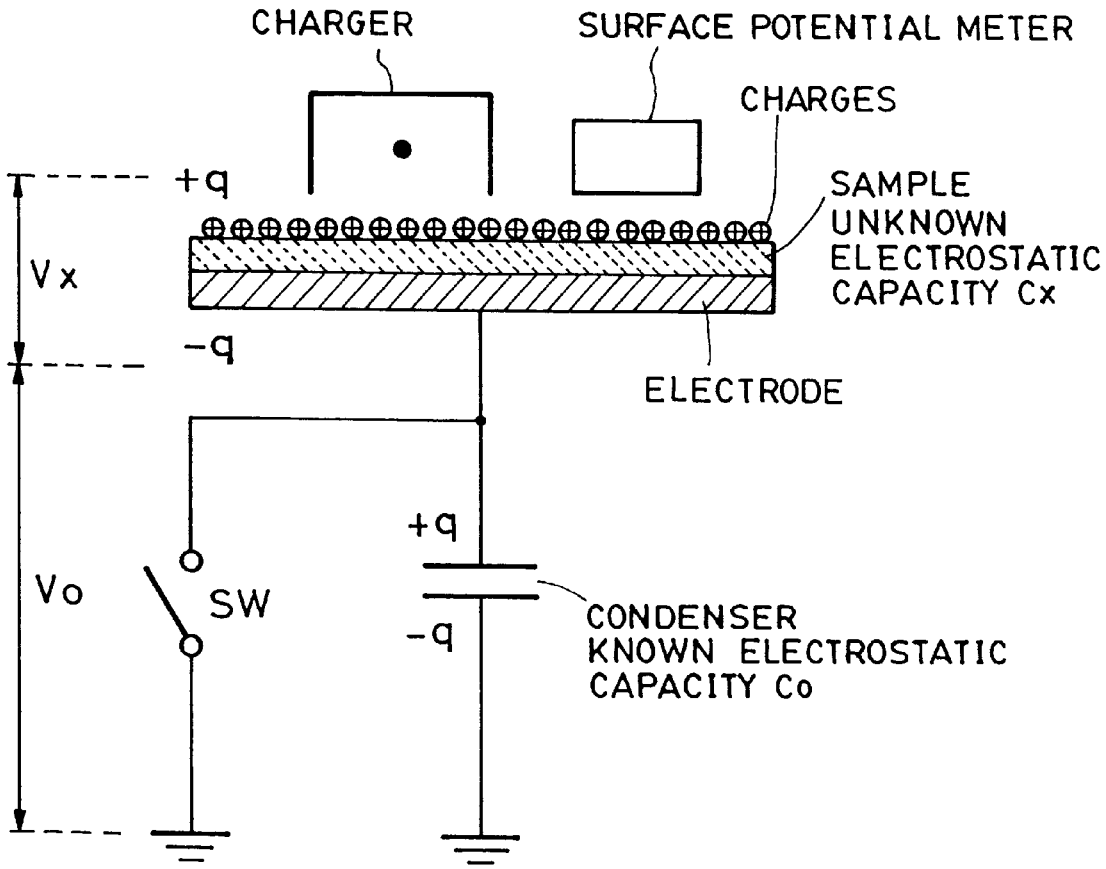
FIG. 2 is also an explanatory view schematically showing the construction of a measuring apparatus for measuring an electrostatic capacity of the electrophotographic photosensitive member formed according to the present invention.

However, an electrostatic capacity (C) in the present invention can be calculated by using an electrostatic capacity measurement apparatus shown in FIG. 2, in accordance with the following procedure.

Namely, a sample (an electrophotographic photosensitive member) whose electrostatic capacity (C) is to be measured, and a condenser whose electrostatic capacity $C_0$ is known, are connected in a manner shown in FIG. 2, so as to electrically charge the sample by means of a corona charger (to which a predetermined DC voltage has already been applied). The related procedures are as follows.

<1> A surface potential meter is used to measure the surface potential of the sample, with the switch SW of the surface potential meter being OFF during the measurement. A measured value at this time is defined as $V_1$.

<2> The switch SW of the surface potential meter is then turned ON so as to measure once again the surface potential of the sample. A measured value at this time is defined as $V_2$.

<3> A method for calculating the electrostatic capacity (C) may be expressed as follows.

$$V_1=V_0+V_2=q/C_0+q/C \quad (1)$$

$$V_2=q/C \quad (2)$$

When the above equations (1) and (2) are combined together and operated in a manner such that q can be erased, it is allowed to obtain the following equation.

$$C=[(V_1-V_2)/V_2]\cdot C_0$$

Further, when the measured electrostatic capacity (C) is divided by a value of the surface area of the sample, it is allowed to obtain an electrostatic capacity (C) per unit area.

The conditions used in evaluating Examples 1 to 4 and Comparative Examples 1 to 4 as well as the evaluation results are shown in Table 2.

TABLE 2

| | Photosensitive Body | Support Body Rmax × D (μm) | Support Body Rz (μm) | Support Body Ra (μm) | Support Body Sm (μm) | Charge Generation Layer Charge Generation Substance | Charge Transport Layer Thickness (μm) | Charge Transport Layer Binder Resin | Electrostatic Capacity C (pF) |
|---|---|---|---|---|---|---|---|---|---|
| Example 1 | Manufacturing Example 1 | 3.0 | 1.6 | 0.24 | 34 | TiOPc | 9 | (1)-2 | 280 |
| Example 2 | Manufacturing Example 2 | 3.0 | 1.6 | 0.24 | 34 | TiOPc | 14 | (1)-2 | 185 |
| Example 3 | Manufacturing Example 3 | 3.0 | 1.6 | 0.24 | 34 | TiOPc | 18 | (1)-2 | 138 |
| Example 4 | Manufacturing Example 4 | 3.0 | 1.6 | 0.24 | 34 | TiOPc | 18 | (1)-15 | 130 |
| Comparative Example 1 | Manufacturing Example 5 | 3.0 | 1.6 | 0.24 | 34 | TiOPc | 20 | (1)-2 | 120 |
| Comparative Example 2 | Manufacturing Example 6 | 3.0 | 1.6 | 0.24 | 34 | TiOPc | 25 | (1)-2 | 95 |
| Comparative Example 3 | Manufacturing Example 7 | 3.0 | 1.6 | 0.24 | 34 | TiOPc | 8 | (1)-2 | 320 |
| Comparative Example 4 | Manufacturing Example 8 | 3.0 | 1.6 | 0.24 | 34 | TiOPc | 18 | | 124 |

| | Field Intensity ($10^5$V/cm) | Potential in Dark Position (V) | Initial Period Ghost/ Black Stripe/ Black Spot/ Interface Fringe | After 15,000 Endurance Ghost/ Black Stripe/ Black Spot/ Oveburden | After 15,000 Endurance Scraped Amount (μm) |
|---|---|---|---|---|---|
| Example 1 | 6.67 | 600 | A/A/A/A | A/A/A/A | 5.0 |
| Example 2 | 4.29 | 600 | B/A/A/A | A/A/A/A | 3.6 |
| Example 3 | 3.33 | 600 | B/A/A/A | B/A/A/A | 2.8 |
| Example 4 | 3.33 | 600 | B/A/A/A | B/A/A/A | 3.0 |
| Comparative Example 1 | 3.00 | 600 | C/D/A/A | C/D/A/C | 2.7 |
| Comparative Example 2 | 2.40 | 600 | E/E/A/A | D/D/A/B | 2.5 |
| Comparative Example 3 | 7.50 | 600 | A/A/B/A | A/C/D/C | 5.2 |
| Comparative Example 4 | 3.33 | 600 | B/B/B/A | C/C/D/C | 6.0 |

<Electrophotographic Photosensitive Member Manufacturing Example 9>

This manufacturing example is almost the same as the above Manufacturing Example 2 except that an air spraying pressure was 0.11 MPa and that the charge generation layer was changed in the following manner, thereby producing an electrophotographic photosensitive member in the same manner as in the above Manufacturing Example 2.

Namely, 3.5 parts of hydroxygallium phthalocyanine (HOGaPc) crystal having a peak strongly durable against the Bragg angles (2θ±0.20) of 7.4° and 28.2° in characteristic X-ray diffraction of $CuK_{\alpha,}$1 part of polyvinyl butyral (trade name: ESLECK BM2, manufactured by Sekisui Chemistry Co., Ltd.), and 60 parts of cyclohexanone were dispersed for 3 hours in a sand mill apparatus using glass beads each having a diameter of 1 mm. Then, 50 parts of cyclohexanone and 130 parts of ethyl acetate were added so as to effect a dilution, thereby obtaining a coating material for forming the charge generation layer. Subsequently, the coating material was applied to the intermediate layer using a dipping treatment, followed by a drying treatment at a temperature of 100° C. for 10 minutes, thereby forming a charge generation layer having a thickness of 0.2 μm.

<Electrophotographic Photosensitive Member Manufacturing Example 10>

This manufacturing example is almost the same as the above Manufacturing Example 2 except that the charge generation layer was changed in the following manner, thereby producing an electrophotographic photosensitive member in the same manner as in the above Manufacturing Example 2.

Namely, 3.5 parts of hydroxygallium phthalocyanine (HOGaPc) crystal having a peak strongly durable against the Bragg angles (2θ+0.2°) of 7.4° and 28.2° in characteristic X-ray diffraction of $CuK_{\alpha}$, 1 part of polyvinyl butyral (trade name: ESLECK BM2, manufactured by Sekisui Chemistry Co., Ltd.), and 60 parts of cyclohexanone were dispersed for 3 hours in a sand mill apparatus using glass beads each having a diameter of 1 mm. Then, 50 parts of cyclohexanone and 130 parts of ethyl acetate were added so as to effect a dilution, thereby obtaining a coating material for forming the charge generation layer. Subsequently, the coating material was applied to the intermediate layer using a dipping treatment, followed by a drying treatment at a temperature of 100° C. for 10 minutes, thereby forming a charge generation layer having a thickness of 0.2 μm.

<Electrophotographic Photosensitive Member Manufacturing Example 11>

This manufacturing example is almost the same as the above Manufacturing Example 9 except that a distance between the gun nozzle and the aluminium pipe was set to be 150 mm, thereby producing an electrophotographic photosensitive member in the same manner as in the above Manufacturing Example 9.

<Electrophotographic Photosensitive Member Manufacturing Example 12>

This manufacturing example is almost the same as the above Manufacturing Example 9 except that the liquid horning conditions were changed in the following manner, thereby producing an electrophotographic photosensitive member in the same manner as in the above Manufacturing Example 9.

Liquid Horning Conditions:

Particles of grinding material=zirconia beads (trade name: ZIRBLAST 120, manufactured by Material Science Co., Ltd.)

Suspension medium=water

Grinding material/suspension medium=1/9 (volume ratio)

Rotation speed of the alminium pipe=1.67 $s^{-1}$

Air spraying pressure=0.05 MPa

Gun moving speed=13.3 mm/s

A distance between the gun nozzle and the aluminium pipe=180 mm

Horning particle discharging angle=45°

Grinding liquid emission=once

<Electrophotographic Photosensitive Member Manufacturing Example 13>

This manufacturing example is almost the same as the above Manufacturing Example 12 except that the air spraying pressure was 0.06 MPa and the gun moving speed was 18 mm/s, thereby producing an electrophotographic photosensitive member in the same manner as in the above Manufacturing Example 12.

<Electrophotographic Photosensitive Member Manufacturing Example 14>

This manufacturing example is almost the same as the above Manufacturing Example 9 except that the liquid horning conditions were changed in the following manner, thereby producing an electrophotographic photosensitive member in the same manner as in the above Manufacturing Example 9.

Liquid Horning Conditions:

Grinding material/suspension medium=2/8 (volume ratio)

Air spraying pressure=0.35 MPa

Gun moving speed=18 mm/s

A distance between the gun nozzle and the aluminium pipe=150 mm

<Electrophotographic Photosensitive Member Manufacturing Example 15>

This manufacturing example is almost the same as the above Manufacturing Example 9 except that the air spraying pressure was 0.38 MPa and the distance between the gun nozzle and the aluminium pipe was 150 mm, thereby producing an electrophotographic photosensitive member in the same manner as in the above Manufacturing Example 9.

<Electrophotographic Photosensitive Member Manufacturing Example 16>

This manufacturing example is almost the same as the above Manufacturing Example 9 except that the liquid horning conditions were changed in the following manner, thereby producing an electrophotographic photosensitive member in the same manner as in the above Manufacturing Example 9.

Liquid Horning Conditions:

Grinding material/suspension medium=2/8 (volume ratio)

Air spraying pressure=0.38 MPa

Gun moving speed=10 mm/s

A distance between the gun nozzle and the aluminium pipe=130 mm

<Electrophotographic Photosensitive Member Manufacturing Example 17>

This manufacturing example is almost the same as the above Manufacturing Example 7 except that the liquid horning conditions were changed in the following manner, thereby producing an electrophotographic photosensitive member in the same manner as in the above Manufacturing Example 7.

Liquid Horning Conditions:

Air spraying pressure=0.05 MPa

Gun moving speed=10 mm/s

A distance between the gun nozzle and the aluminium pipe=200 mm

<Electrophotographic Photosensitive Member Manufacturing Example 18>

This manufacturing example is almost the same as the above Manufacturing Example 7 except that the air spraying pressure was 0.38 MPa and the gun moving speed was 25 mm/s, thereby producing an electrophotographic photosensitive member in the same manner as in the above Manufacturing Example 7.

<Electrophotographic Photosensitive Member Manufacturing Example 19>

This manufacturing example is almost the same as the above Manufacturing Example 7 except that the liquid horning conditions were changed in the following manner, thereby producing an electrophotographic photosensitive member in the same manner as in the above Manufacturing Example 7.

Air spraying pressure=0.02 MPa

Gun moving speed=8.0 mm/s

A distance between the gun nozzle and the aluminium pipe=200 mm

Horning particle discharging angle=90°

<Electrophotographic Photosensitive Member Manufacturing Example 20>

This manufacturing example is almost the same as the above Manufacturing Example 9 except that the air spraying pressure was 0.02 MPa, thereby producing an electrophotographic photosensitive member in the same manner as in the above Manufacturing Example 9.

<Electrophotographic Photosensitive Member Manufacturing Example 21>

This Manufacturing Example is almost the same as the above Manufacturing Example 9 except that the air spraying pressure was 0.35 MPa and the distance between the gun nozzle and the aluminium pipe was 150 mm, thereby producing an electrophotographic photosensitive member in the same manner as in the above Manufacturing Example 9.

<Electrophotographic Photosensitive Member Manufacturing Example 22>

This Manufacturing Example is almost the same as the above Manufacturing Example 9 except that the grinding material particles were stainless beads (trade name: BPS 150 (SUS 304), manufactured by Ito Machine Idustry Co., Ltd.), and that the air spraying pressure was 0.04 MPa and the distance between the gun nozzle and the aluminium pipe was 150 mm, thereby producing an electrophotographic photosensitive member in the same manner as in the above Manufacturing Example 9.

(Examples 5 to 10 and Comparative Examples 5 to 12)

The electrophotographic photosensitive members produced in the above manufacturing examples 9 to 22 were used as shown in Table 3. An LBP (trade name: Laser Jet 4000, manufactured by Hewlett Packard Co., Ltd.) (process speed: 94.2 mm/s), was reformed into a structure capable of carrying out DC electric charging. Then, process conditions were set as follows and evaluation was carried out.

Electrophotographic photosensitive member dark position potential: −600 V

Electrophotographic photosensitive member bright position potential: −150 V

Developing bias: −350 V (DC voltage only)

Electrophotographic photosensitive member electrostatic capacity: 185 pF

Electric Field Intensity $-4.29\times10^5$

The evaluation was carried out under a condition of 15° C./10 RH %, thereby evaluating an initial image. In detail, image evaluation was carried out in the following manner. Namely, in an area from the start of print image to one rotation of the electrophotographic photosensitive member, solid black pieces each having a square shape of 25 mm are arranged. From the photosensitive member's second rotation onward, ghost phenomenon was evaluated by using a half-tone test chart having printed thereon 1 dot using a checker. Then, in accordance with another half-tone test chart having printed thereon 1 dot using a checker, and in view of the solid black images, another evaluation was carried out to evaluate black stripes, black spots and interference fringes caused due to an ununiform electric charging. Then, the printing of 15000 sheets of pictures was continuously performed on A4 papers, using a printing pattern having an area ratio of 4%, followed by evaluating the formed pictures.

The conditions used in carrying out the evaluation of Examples 5 to 10 and Comparative Examples 5 to 12, as well as the evaluation results are shown in Table 3.

TABLE 3

| | | Support Body | | | | Charge Generation Layer Charge | Charge Transport Layer | | Electrostatic |
|---|---|---|---|---|---|---|---|---|---|
| | Photosensitive Body | Rmax × D (μm) | Rz (μm) | Ra (μm) | Sm (μm) | Generation Substance | Thickness (μm) | Binder Resin | Capacity C (pF) |
| Example 5 | Manufacturing Example 9 | 2.0 | 1.2 | 0.15 | 32 | HOGaPc | 14 | (1)-2 | 185 |
| Example 6 | Manufacturing Example 10 | 3.0 | 1.6 | 0.24 | 34 | HOGaPc | 14 | (1)-2 | 185 |
| Example 7 | Manufacturing Example 11 | 4.5 | 2.0 | 0.30 | 31 | HOGaPc | 14 | (1)-2 | 185 |
| Example 8 | Manufacturing Example 12 | 2.1 | 1.2 | 0.16 | 75 | HOGaPc | 14 | (1)-2 | 185 |
| Example 9 | Manufacturing Example 13 | 2.3 | 1.4 | 0.17 | 80 | HOGaPc | 14 | (1)-2 | 185 |
| Example 10 | Manufacturing Example 14 | 5.0 | 3.0 | 0.50 | 34 | HOGaPc | 14 | (1)-2 | 185 |
| Comparative Example 5 | Manufacturing Example 15 | 5.3 | 2.8 | 0.39 | 32 | HOGaPc | 14 | (1)-2 | 185 |
| Comparative Example 6 | Manufacturing Example 16 | 5.0 | 3.2 | 0.38 | 33 | HOGaPc | 14 | (1)-2 | 185 |
| Comparative Example 7 | Manufacturing Example 17 | 1.8 | 1.1 | 0.17 | 34 | HOGaPc | 14 | (1)-2 | 185 |
| Comparative Example 8 | Manufacturing Example 18 | 4.9 | 2.4 | 0.51 | 38 | HOGaPc | 14 | (1)-2 | 185 |
| Comparative Example 9 | Manufacturing Example 19 | 1.5 | 1.2 | 0.14 | 37 | HOGaPc | 14 | (1)-2 | 185 |
| Comparative Example 10 | Manufacturing Example 20 | 1.1 | 0.9 | 0.13 | 40 | HOGaPc | 14 | (1)-2 | 185 |
| Comparative Example 11 | Manufacturing Example 21 | 5.0 | 2.3 | 0.35 | 30 | HOGaPc | 14 | (1)-2 | 185 |
| Comparative Example 12 | Manufacturing Example 22 | 2.9 | 1.5 | 0.20 | 85 | HOGaPc | 14 | (1)-2 | 185 |

| | Field Intensity ($10^5$V/cm) | Potential in Dark Position (V) | Initial Period Ghost/ Black Stripe/ Black Spot/ Interface Fringe | After 15,000 Endurance Ghost/ Black Stripe/ Black Spot/ Oveburden | After 15,000 Endurance Scraped Amount (μm) |
|---|---|---|---|---|---|
| Example 5 | 4.29 | 600 | A/A/A/B | A/A/A/A | 3.5 |
| Example 6 | 4.29 | 600 | A/A/A/A | A/A/A/A | 3.6 |
| Example 7 | 4.29 | 600 | A/A/A/A | A/A/A/B | 3.7 |
| Example 8 | 4.29 | 600 | A/A/B/A | A/A/B/A | 3.5 |
| Example 9 | 4.29 | 600 | A/B/B/A | B/B/B/B | 3.6 |
| Example 10 | 4.29 | 600 | A/A/B/A | A/A/B/B | 3.7 |
| Comparative Example 5 | 4.29 | 600 | A/B/C/A | A/C/E/C | 3.7 |
| Comparative Example 6 | 4.29 | 600 | A/B/C/A | A/B/D/C | 3.8 |
| Comparative Example 7 | 4.29 | 600 | A/B/A/D | B/B/B/B | 3.4 |

TABLE 3-continued

| | | | | | |
|---|---|---|---|---|---|
| Comparative Example 8 | 4.29 | 600 | A/A/C/B | A/B/D/C | 3.5 |
| Comparative Example 9 | 4.29 | 600 | A/B/A/D | B/B/B/B | 3.4 |
| Comparative Example 10 | 4.29 | 600 | —/—/—/E | Difficult to Evaluate | — |
| Comparative Example 11 | 4.29 | 600 | A/B/B/B | B/C/B/C | 3.6 |
| Comparative Example 12 | 4.29 | 600 | A/C/C/B | B/D/B/D | 3.5 |

<Electrophotographic Photosensitive Member Manufacturing Example 23>

This manufacturing example is almost the same as the above Manufacturing Example 2 except that the charge generation layer was changed in the following manner, thereby producing an electrophotographic photosensitive member in the same manner as in the above Manufacturing Example 2.

Namely, 3.5 parts of hydroxygallium phthalocyanine crystal having a peak strongly durable against the Bragg angles (2θ±0.2°) of 7.4° and 28.2° in characteristic X-ray diffraction of $CuK_{\alpha}$, 1 part of polyvinyl butyral (trade name: ESLECK BM2 manufactured by Sekisui Chemistry Co., Ltd.), and 60 parts of cyclohexanone were dispersed for 3 hours in a sand mill apparatus using glass beads each having a diameter of 1 mm. Then, 50 parts of cyclohexanone and 130 parts of ethyl acetate were added so as to effect a dilution, thereby obtaining a coating material for forming the charge generation layer. Subsequently, the coating material was applied to the intermediate layer through a dipping treatment, followed by a drying treatment at a temperature of 100° C. for 10 minutes, thereby forming a charge generation layer having a thickness of 0.2 μm.

<Electrophotographic Photosensitive Member Manufacturing Example 24>

This manufacturing example is almost the same as the above Manufacturing Example 23 except that a binder resin for use in the charge transport layer was a polyarylate resin (having an average molecular weight of 95000) formed by copolymerizing (mole ratio 50:50) two kinds of constitutive units represented by (1)-3 and (1)-23 (with one containing ester group in m-position and the other in p-position, each occupying 50% in the copolymer), thereby producing an electrophotographic photosensitive member in the same manner as in the above Manufacturing Example 23.

<Electrophotographic Photosensitive Member Manufacturing Example 25>

This manufacturing example is almost the same as the above Manufacturing Example 23 except that thickness of the charge transport layer was 16 μm, thereby producing an electrophotographic photosensitive member in the same manner as in the above Manufacturing Example 23.

<Electrophotographic Photosensitive Member Manufacturing Example 26>

This manufacturing example is almost the same as the above Manufacturing Example 23 except that the polymer of the charge transport layer was bisphenol Z type polycarbonate (trade name: YOUPILON-200, manufactured by Mitsubishi Chemistry Co., Ltd.), thereby producing an electrophotographic photosensitive member in the same manner as in the above Manufacturing Example 23.

<Electrophotographic Photosensitive Member Manufacturing Example 27>

This manufacturing example is almost the same as the above Manufacturing Example 23 except that hydroxygallium phthalocyanine was a metal-free phthalocyanine (metal-free Pc), thereby producing an electrophotographic photosensitive member in the same manner as in the above Manufacturing Example 23.

(Examples 11 to 17 and Comparative Examples 13, 14)

Electrophotographic photosensitive members manufactured in the Manufacturing Examples 23 to 27 were used, and dark position potentials of the electrophotographic photosensitive members were changed in a manner shown in Table 4, so as to change an electric field applied to each electrophotographic photosensitive member, thereby evaluating the properties of photosensitive members obtained in these Examples.

Then, the printing of 15000 sheets of pictures was continuously performed on A4 papers, using a printing pattern having an area ratio of 4%, followed by evaluating the formed pictures.

Conditions used in evaluating Examples 11 to 17 and Comparative Examples 13, 14 as well as the evaluation results are shown in Table 4.

TABLE 4

| | | Support Body | | | | Charge Generation Layer Charge | Charge Transport Layer | | Electrostatic |
|---|---|---|---|---|---|---|---|---|---|
| | Photosensitive Body | Rmax × D (μm) | Rz (μm) | Ra (μm) | Sm (μm) | Generation Substance | Thickness (μm) | Binder Resin | Capacity C (pF) |
| Example 11 | Manufacturing Example 23 | 3.0 | 1.6 | 0.24 | 34 | HOGaPc | 14 | (1)-2 | 185 |
| Example 12 | Manufacturing Example 24 | 3.0 | 1.6 | 0.24 | 34 | HOGaPc | 14 | (1)-2 | 185 |
| Example 13 | Manufacturing Example 25 | 3.0 | 1.6 | 0.24 | 34 | HOGaPc | 14 | (1)-2 | 185 |

TABLE 4-continued

| | | | | | | | | | |
|---|---|---|---|---|---|---|---|---|---|
| Example 14 | Manufacturing Example 26 | 3.0 | 1.6 | 0.24 | 34 | HOGaPc | 14 | (1)-3/ (1)-23 | 185 |
| Example 15 | Manufacturing Example 27 | 3.0 | 1.6 | 0.24 | 34 | HOGaPc | 14 | (1)-2 | 185 |
| Example 16 | Manufacturing Example 28 | 3.0 | 1.6 | 0.24 | 34 | HOGaPc | 16 | (1)-2 | 160 |
| Example 17 | Manufacturing Example 29 | 3.0 | 1.6 | 0.24 | 34 | HOGaPc | 14 | (1)-2 | 185 |
| Comparative Example 13 | Manufacturing Example 30 | 3.0 | 1.6 | 0.24 | 34 | HOGaPc | 14 | polycar-bonate | 190 |
| Comparative Example 14 | Manufacturing Example 31 | 3.0 | 1.6 | 0.24 | 34 | Pc Not Containing Metal Component | 14 | (1)-2 | 185 |

| | | | Initial Period Ghost/ | After 15,000 Endurance | |
|---|---|---|---|---|---|
| | Field Intensity ($10^5$V/cm) | Potential in Dark Position (V) | Black Stripe/ Black Spot/ Interface Fringe | Ghost/ Black Stripe/ Black Spot/ Oveburden | Scraped Amount ($\mu$m) |
| Example 11 | 3.60 | 500 | B/A/A/A | A/A/A/A | 3 |
| Example 12 | 4.60 | 650 | A/A/A/A | A/A/A/A | 3.8 |
| Example 13 | 5.70 | 800 | A/A/A/A | A/A/A/A | 4.5 |
| Example 14 | 5.70 | 800 | A/A/A/A | A/A/A/A | 4.0 |
| Example 15 | 3.20 | 450 | C/B/A/A | A/A/A/A | 2.8 |
| Example 16 | 8.10 | 1300 | A/A/A/A | A/A/B/B | 5.8 |
| Example 17 | 8.20 | 1150 | A/A/A/A | A/A/B/C | 6.1 |
| Comparative Example 13 | 5.70 | 800 | A/A/A/A | A/B/C/D | 7.0 |
| Comparative Example 14 | 3.60 | 500 | C/B/A/A | C/B/C/C | 3.2 |

As may be clearly understood from the above Tables 2 to 4, with the use of the electrophotographic photosensitive member and the electrophotographic apparatus containing the photosensitive member, it has become possible to provide images having a high picture quality, in a stabilized manner and during a long time period, without having to carry out any complex process.

Further, in order to achieve a high picture quality while at the same time to constantly maintain a high durability, it is most preferable that the charge generation substance be hydroxygallium phthalocyanine.

In this way, with the use of the present invention, it has become possible to provide an improved electrophotographic photosensitive member and an improved electrophotographic apparatus containing the improved photosensitive member, making it sure to constantly and stably produce high quality images free from black stripe, black spot, interference fringe and ghost phenomenon.

While the present invention has been described with reference to what are presently considered to be the preferred embodiments, it is to be understood that the invention is not limited to the disclosed embodiments. on the contrary, the invention is intended to cover various modifications and equivalent arrangements included within the sprite and scope of the appended claims. The scope of the following claims is to be accorded the broadest interpretation so as to encompass all such modifications and equivalent structures and functions.

What is claimed is:

1. An electrophotographic photosensitive member comprising a support portion, a charge generation layer and a charge transport layer, wherein the charge generation layer contains a phthalocyanine compound; the phthalocyanine compound is selected from the group consisting of oxytitanium phthalocyanine and hydroxygallium phthalocyanine; the charge transport layer has a thickness which is at least 9 $\mu$m but not larger than 18 $\mu$m; the charge transport layer contains polyarylate resin having repeated constitutive units represented by the following formula (1):

(1)

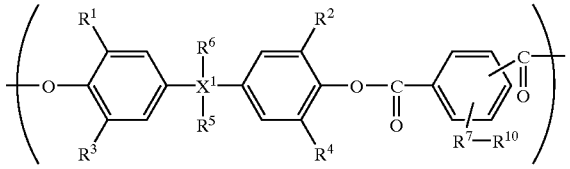

wherein $X^1$ represents a carbon atom or a single bond when $X^1$ represents a single bond and $R^5$ and $R^6$ are not present, $R^1$ to $R^4$ represent a hydrogen atom, a halogen atom, a substituted or unsubstituted alkyl group, or a substituted or unsubstituted aryl group, $R^5$ and $R^6$ represent a hydrogen atom, a halogen atom, a substituted or unsubstituted alkyl group, or a substituted or unsubstituted aryl group, or an alyklidene group formed by combining $R^5$ with $R^6$, and $R^7$ and $R^{10}$ also represent a hydrogen atom, a halogen atom, a substituted or unsubstituted alkyl group, or a substituted or unsubstituted aryl group; and the electrophotographic photosensitive member in every 1 $cm^2$ area has an electrostatic capacity (C) of 130 pF or more, wherein the maximum height (RmaxD) of a surface roughness of the support portion, the average roughness (Rz) of 10 points, the arithmetic average roughness (Ra), and the irregularity average interval (Sm) satisfy the following conditions:

$1.2\ \mu m \leqq RmaxD \leqq 5.0\ \mu m$, $1.2\ \mu m \leqq Rz \leqq 3.0\ \mu m$, $0.15\ \mu m \leqq Ra \leqq 0.5\ \mu m$, and $30\ \mu m < Sm \leqq 80\ \mu m$.

2. An electrophotographic photosensitive member according to claim 1, wherein the maximum height (RmaxD) satisfies the following condition:

$1.2\ \mu m \leqq RmaxD \leqq 4.5\ \mu m$.

3. An electrophotographic photosensitive member according to claim 1, wherein the average roughness (Rz) of 10 points satisfies the following condition:

$1.2\ \mu m \leqq Rz \leqq 2.0\ \mu m$.

4. An electrophotographic photosensitive member according to claim 1, wherein the arithmetic average roughness (Ra) satisfies the following condition:

$0.15\ \mu m \leqq Ra \leqq 0.3\ \mu m$.

5. An electrophotographic photosensitive member according to claim 1, wherein the irregularity average interval (Sm) satisfies the following condition:

$31\ \mu m \leqq Sm \leqq 80\ \mu m$.

6. An electrophotographic photosensitive member according to claim 1, wherein the maximum height (RmaxD), the average roughness (Rz) of 10 points, the arithmetic average roughness (Ra), and the irregularity average interval (Sm) satisfy the following conditions:

$1.2\ \mu m \leqq RmaxD \leqq 4.5\ \mu m$, $1.2\ \mu m \leqq Rz \leqq 2.0\ \mu m$, $0.15\ \mu m \leqq Ra > 0.3\ \mu m$, and $30\ \mu m < Sm \leqq 80\ \mu m$.

7. An electrophotographic photosensitive member according to claim 1, wherein said oxytitanium phthalocyanine is an oxytitanium phthalocyanine having a peak strongly durable against the Bragg angles (2θ±0.2°) of 9.0°, 14.2°, 23.9° and 27.1° in characteristic X-ray diffraction of $CuK_{\alpha}$.

8. An electrophotographic photosensitive member according to claim 1, wherein said hydroxygallium phthalocyanine is hydroxygallium phthalocyanine having a peak strongly durable against the Bragg angles (2θ±0.2°) of 7.4° and 28.2° in characteristic X-ray diffraction of $CuK_{\alpha}$.

9. A process cartridge comprising an electrophotographic photosensitive member and at least one of electric charging means, developing means, and cleaning means, all of which are integrally supported together and are attachable to or detachable from an electrophotographic apparatus, said electrophotographic photosensitive member comprising a support portion, a charge generation layer, and a charge transport layer, wherein said charge generation layer contains a phthalocyanine compound; the phthalocyanine compound is selected from the group consisting of oxytitanium phthalocyanine and hydroxygallium phthalocyanine; wherein said charge transport layer has a thickness which is at least 9 μm but not larger than 18 μm,; the charge transport layer contains polyarylate resin having repeated constitutive units represented by the following formula (1):

(1)

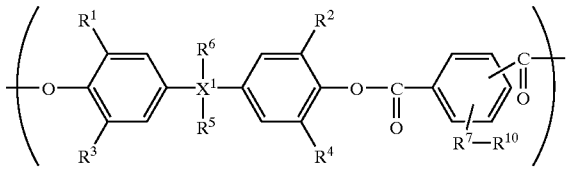

wherein $X^1$ represents a carbon atom or a single bond when $X^1$ represents a single bond and $R^5$ and $R^6$ are not present, $R^1$ to $R^4$ represent a hydrogen atom, a halogen atom, a substituted or unsubstituted alykl group, or a substituted or unsubstituted aryl group, $R^5$ and $R^6$ represent a hydrogen atom, a halogen atom, a substituted or unsubstituted alkyl group, or a substituted or unsubstituted aryl group, or an alyklidene group formed by combining $R^5$ and $R^{6,}$ and $R^7$ to $R^{10}$ also represent a hydrogen atom, a halogen atom, a substituted or unsubstituted alykl group, or a substituted or unsubstituted aryl group; and wherein the electrophotographic photosensitive member in every 1 $cm^2$ area has an electrostatic capacity (C) of 130 pF or more, and wherein the maximum height (RmaxD) of the surface roughness portion of the support portion, the average roughness (Rz) of 10 points, the arithmetic average roughness (Ra), and the irregularity average interval (Sm) satisfy the following conditions:

$1.2\ \mu m \leqq RmaxD \leqq 5.0\ \mu m$, $1.2\ \mu m \leqq Rz \leqq 3.0\ \mu m$, $0.15\ \mu m \leqq Ra\ 0.5\ \mu m$, and $30\ \mu m < Sm \leqq 80\ \mu m$.

10. A process cartridge according to claim 9, wherein said process cartridge contains electric charging means.

11. A process cartridge according to claim 10, wherein at the time the electric charging means is operated to electrically charge the electrophotographic photosensitive member, the electric field being applied to the electrophotographic photosensitive member is $3.3\times10^5$ to $8.1\times10^5$ V/cm.

12. A process cartridge according to claim 10, wherein the electric charging means is a contact-type charging means.

13. A process cartridge according to claim 12, wherein the electrophotographic photosensitive member is electrically charged only with a DC voltage, using said contact-type electric charging means.

14. A process cartridge according to claim 12, wherein said contact-type electric charging means is an electric charging roller.

15. An electrophotographic apparatus comprising an electrophotographic photosensitive member, electric charging means, developing means, and cleaning means, wherein said electrophotographic photosensitive member includes a support portion, a charge generation layer, and a charge transport layer, wherein the charge generation layer contains a phthalocyanine compound, the phthalocyanine compound is selected from the group consisting of oxytitanium phthalocyanine and hydroxygallium phthalocyanine; wherein the charge transport layer has a thickness which is at least 9 μm but not larger than 18 $\mu$m, the charge transport layer contains polyarylate resin having repeated constitutive units represented by the following formula (1):

(1)

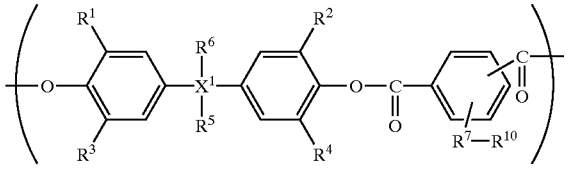

wherein $X^1$ represents a carbon atom or a single bond when $X^1$ represents a single bond and $R^5$ and $R^6$ are not present, $R^1$ and $R^4$ represent a hydrogen atom, a halogen atom, a substituted or unsubstituted alkyl group, or a substituted or unsubstituted aryl group, $R^5$ and $R^6$ represent a hydrogen atom, a halogen atom, a substituted or unsubstituted alkyl group, or a substituted or unsubstituted aryl group, or an alkylidene group formed by combining $R^5$ and $R^6$, and $R^7$ and $R^{10}$ also represent a hydrogen atom, a halogen atom, a substituted or unsubstituted alkyl group, or a substituted or unsubstituted aryl group; and wherein the electrophotographic photosensitive member in every 1 $cm^2$ area has an electrostatic capacity (C) of 130 pF or more, and wherein the maximum height (RmaxD) of the surface roughness portion of the support portion, the average roughness (Rz) of 10 points, the arithmetic average roughness (Ra) and the irregularity average interval (Sm) satisfy the following conditions:

$$1.2\ \mu m \leqq RmaxD \leqq 5.0\ \mu m,$$

$$1.2\ \mu m \leqq Rz \leqq 3.0\ \mu m,$$

$$0.15\ \mu m \leqq Ra \leqq 0.5\ \mu m, \text{ and}$$

$$30\ \mu m < Sm \leqq 80\ \mu m.$$

16. An electrophotographic apparatus according to claim 15, wherein at the time the electric charging means is operated to electrically charge the electrophotographic photosensitive member, the electric field being applied to the electrophotographic photosensitive member is $3.3\times10^5$ to $8.1\times10^5$ V/cm.

17. An electrophotographic apparatus according to claim 15, wherein the electric charging means is a contact-type charging means.

18. An electrophotographic apparatus according to claim 17, wherein the electrophotographic photosensitive member is electrically charged only with a DC voltage, using said contact-type electric charging means.

19. An electrophotographic apparatus according to claim 17, wherein said contact-type electric charging means is an electric charging roller.

20. An electrophotographic apparatus according to claim 17, wherein said electrophotographic apparatus is not equipped with a pre-exposing means which, with the use of a pre-exposing light, performs a charge removal treatment on the surface of said electrophotographic photosensitive member before the electrophotographic photosensitive member is electrically charged by said contact-type electric charging means.

* * * * *

UNITED STATES PATENT AND TRADEMARK OFFICE

CERTIFICATE OF CORRECTION

PATENT NO. : 6,541,172 B2
DATED : April 1, 2003
INVENTOR(S) : Hideaki Nagasaka et al.

It is certified that error appears in the above-identified patent and that said Letters Patent is hereby corrected as shown below:

Title page,
Item [57], ABSTRACT,
Line 5, "1.2 $\mu$m" should read -- 1.2 $\mu$m $\leq$ --.

Column 1,
Line 44, "sensibility" should read -- sensitivity --.

Column 5,
Line 29, "tow" should read -- two --.
Line 56, "server" should read -- serve --.

Column 7,
Line 39, "4.5 $\mu$m. [ ] Further," should read -- 4.5 $\mu$m. Further, --.

Column 8,
Line 55, "will" should read -- well --.

Column 19,
Line 34, "N-methoxymetyl" should read -- N-methoxymethyl --.

Column 33,
Line 67, "18 $\mu$m,;" should read -- 18 $\mu$m; --.

Signed and Sealed this

Eighteenth Day of November, 2003

JAMES E. ROGAN
*Director of the United States Patent and Trademark Office*